United States Patent [19]

Yoshizumi

[11] Patent Number: 4,488,021

[45] Date of Patent: Dec. 11, 1984

[54] GAS INSULATED DISCONNECTOR

[75] Inventor: Toshiaki Yoshizumi, Minoo, Japan

[73] Assignee: Mitsubishi Denki Kabushiki Kaisha, Tokyo, Japan

[21] Appl. No.: 439,605

[22] Filed: Nov. 5, 1982

[30] Foreign Application Priority Data

Nov. 12, 1981 [JP] Japan ..... 56-182551
Nov. 12, 1981 [JP] Japan ..... 56-182553

[51] Int. Cl.[3] ..... H01N 33/16
[52] U.S. Cl. ..... 200/144 AP; 200/145; 200/146 R
[58] Field of Search ..... 200/144 AP, 145, 146

[56] References Cited

U.S. PATENT DOCUMENTS 3,538,278 11/1970 Rathbun ..... 200/144 AP

FOREIGN PATENT DOCUMENTS 1167939 4/1964 Fed. Rep. of Germany ..... 200/144 AP
2827482 1/1980 Fed. Rep. of Germany ..... 200/144 AP
53-95276 8/1978 Japan .
54-113874 9/1979 Japan .
54-139075 10/1979 Japan .
1089575 11/1967 United Kingdom ..... 200/144 AP

*Primary Examiner*—Robert S. Macon
*Attorney, Agent, or Firm*—Leydig, Voit, Osann, Mayer and Holt, Ltd.

[57] ABSTRACT

A circuit including arcing contacts is connected in parallel with main contacts of a disconnector to facilitate interruption of a loop current caused through the disconnector when switching main bus bars in a power station. A switching surge suppression resistor is adapted to be inserted in and removed from the circuit of the arcing contacts. Plural pairs of arcing contacts are provided in the circuit of arcing contacts.

4 Claims, 15 Drawing Figures

GAS INSULATED DISCONNECTOR

BACKGROUND OF THE INVENTION

This invention relates to a gas insulated connector capable of interrupting a loop current.

Disconnectors in power station premises are usually installed adjacent to circuit breakers. They are used typically for isolating a circuit after interruption of current therein by a circuit breaker or for switching power transmission systems. The former function is the isolation of a no-load circuit by the disconnector. At the time of the isolation of the no-load circuit by the disconnector, re-arcing repeatedly takes place between the disconnecting switch contacts giving rise to a commonly termed switching surge having high sharpness. This occurs because of the fact that the switching speed of the disconnector is slow compared to the circuit breaker. It has been the practice to add a resistor to the disconnector in order to suppress such a switching surge.

An example of the latter function of the disconnector is the switching of main bus bars in a power station by disconnectors. FIG. 1 shows the case of switching the connection of bus bars A and B in (a) to that in (b) by making use of a satisfactory interrupting capacity of $SF_6$ gas. In this operation, a current which is close to the rated current in the circuit including the disconnectors A1 and B1 (which is referred to as loop current) is interrupted.

The function of isolating a no-load circuit and the function of switching a loop current, as noted above, are often required for one disconnector in a power station.

A prior art disconnector provided with a resistor for suppressing the switching surge as described above is shown in FIG. 2. The disconnector comprises a tank 1, which is filled with gas capable of extinguishing arc. The tank 1 is sealed by insulating spacers 2 and 3. Conductors 4 and 5 are secured to the respective insulating spacers 2 and 3. A shield member 6 made of a conductor is secured to the conductor 4. The shield member 6*a* has an opening. A main contact 7 is disposed as a fixed contact in the shield member 6 such that it faces the opening 6*a* thereof. The main contact 7 is secured to and electrically connected to the shield member 6. A resistor 8 is secured at one end to the shield body 6. The resistor 8 includes an insulating rod 8*a* and a resisting element 8*b* as shown in FIG. 6 and as will be described later in detail. A cylindrical spring case 9 is secured to the other end of the resistor 8. A conductive support rod 10 is slidably supported in the spring case 9 and extends in the fixed contact 7. The support rod 10 is provided at one end with a fixed arcing contact 10*a* which is capable of withstanding arcing. It can be moved up to a position, at which the end of the arcing contact 10*a* projects from the shield member 6. The arcing contact 10*a* is connected to the other end of the resistor 8 through the spring case 9. A spring 11 biases the support rod 10 in such a direction that it projects from the shield member 6. Another shield member 12 made of a conductor is secured to the conductor 5. The shield member 12 has an opening 12*a*. A movable main contact 13 is movably supported in the shield member 12. The main contact 13 is provided at one end with a movable arcing contact 13*a* which is capable of withstanding arcing. As the main contact 13 is moved to the right from the state of FIG. 2, it is broken apart from the fixed main contact 7 before the arcing contacts 10*a* and 13*a* are broken apart. A contact 14 which can be in sliding contact with the movable main contact 13 is connected to the shield member 12. An insulating operating rod 15 is coupled to the main contact 13. A link mechanism 16 transmits a driving force of a driving source (not shown) to the main contact 13 via the insulating operationg rod 15.

In operation, with the rightward movement of the insulating operating rod 15 in FIG. 2, the movable main contact 13 is broken apart from the fixed main contact 7. The arcing contact 10*a* is caused to follow the movable arcing contact 13*a* by the action of the spring 11. The arcing contact 10*a* can be moved up to a position, at which the electric field intensity at the end of the arcing contact 10*a* is higher than the electric field intensity at all parts of the shield member 6, i.e., at a position at which the end of the arcing contact 10*a* projects from the shield member 6. The main contact 13 can be moved beyond this position so that arcing is eventually produced between the arcing contacts 10*a* and 13*a*. The arcing contact 10*a* is stopped at a position, at which the electric field intensity at its end is higher than the electric field intensity at all parts of the shield member 6. Thus, a number of arc discharges (re-arcing) all occur between the arcing contacts 10*a* and 13*a* during the switching operation. In consequence, an abnormal voltage (i.e., switching surge) generated at the time of isolating the no-load circuit can be suppressed.

FIGS. 3 and 4 are equivalent circuit diagrams showing a succession of states that occur when a loop current is interrupted using a disconnector provided with the surge suppression resistor shown in FIG. 2. In the state of FIG. 3, the disconnector is perfectly closed, and in the stage of FIG. 4 only the main contacts have been broken apart. In FIGS. 3 and 4, the same reference numerals and symbols as in FIG. 2 designate corresponding parts. Indicated at Zm is the impedance of the main current path of the disconnector, indicated at Zl is the impedance of the loop established at the time of the switching of the system, and indicated at R is the resistance of the surge suppression resistor. These impedance values are generally related as $$Zm << Zl << R \quad (1)$$

The equivalent circuit of FIG. 4 shows the state that results immediately after the start of operation of the disconnector with the surge suppression resistor shown in FIG. 2 to interrupt a loop current. At this time, R and Zm are related as $Zm << R$ from the inequality 1. If the resistance R is set to be considerably greater than the resistance offered to the arc produced between the main contacts 7 and 13, the loop current scarely flows through the path including the resistor 8, fixed arcing contact 10*a* and movable arcing contact 13*a*, that is, it substantially flows through the path including the main contacts 7 and 13. That is, most of the loop current i, for instance about 10 killoamperes, must be interrupted between the main contacts 7 and 13.

In a disconnector capable of interrupting a large loop current, the arcing contacts 10*a* and 13*a* usually are capable of withstanding arcing so that an arc due to the loop current can be interrupted between the arcing contacts 10*a* and 13*a* for ensuring a current-carrying performance after the interruption of the current. In other words, the main contacts 7 and 13 usually are incapable of withstanding arcing.

If the resistance R of the resistor 8 is set to be comparatively low with respect to the resistance offered to the arcing generated between the main contacts 7 and 13 when these contacts 7 and 13 are broken apart, a large current is caused to flow through the path including the resistor 8 and arcing contacts 10*a* and 13*a* with arcing generated between the main contacts 7 and 13 when the contacts 7 and 13 are broken apart. A voltage drop across the resistor 8 is thus applied between the main contacts 7 and 13. In this case, the interruption of the loop current is extremely difficult compared to the case of absence of the resistor 8, i.e., the case where the voltage drop across the resistor 8 is zero. If the resistance R of the resistor 8 is set to be very low, even the function of surge suppression substantially cannot be obtained.

For the above reasons, it has been thought difficult to add a function of interrupting loop current to the conventional disconnector with a surge suppression resistor.

SUMMARY OF THE INVENTION

The invention has been intended in the light of the foregoing, and its object is to provide a disconnector, which can interrupt loop current with bypass contacts provided to shunt a surge suppression resistor when interrupting the loop current.

Another object of the invention is to facilitate the interruption of loop current and prevent wear of the main contacts.

BRIEF DESCRIPTION OF THE DRAWINGS

In the Figures, like parts are designated by like reference symbols.

DESCRIPTION OF THE PREFERRED EMBODIMENT

Figure 1:
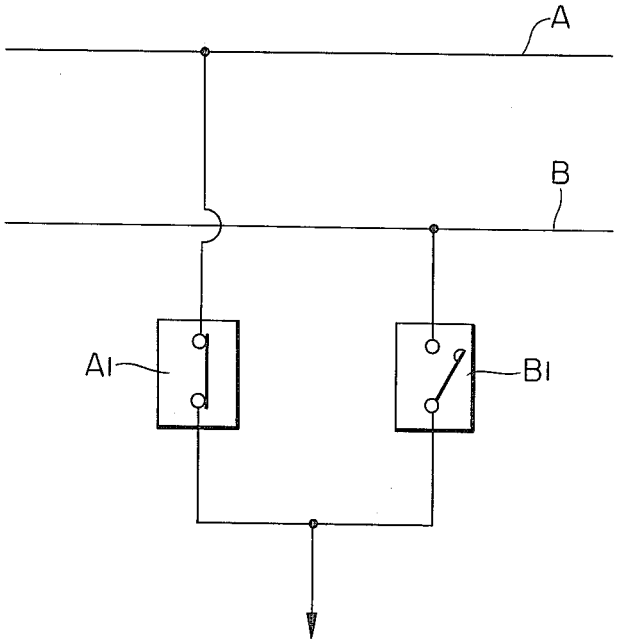
FIGS. 1*a* and 1*b* show a bus bar switching circuit in different states.
Figure 1:
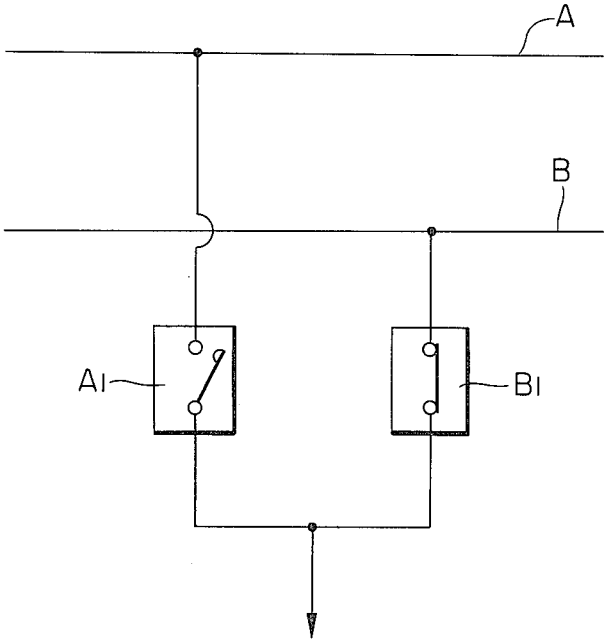
Figure 2:
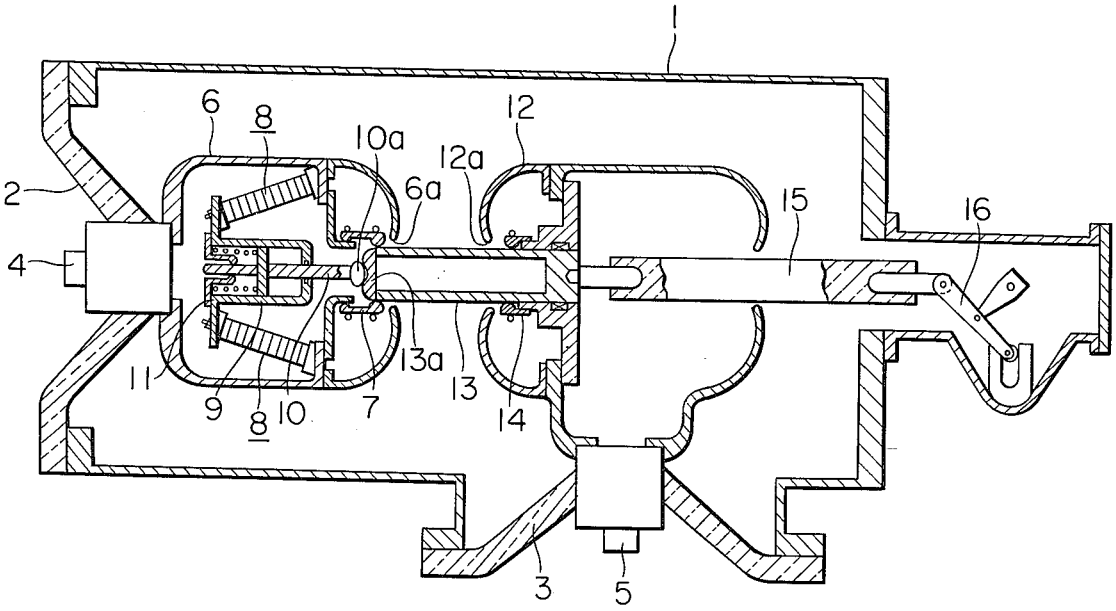
FIG. 2 PRIOR ART
FIG. 2 is a longitudinal sectional view showing a prior art disconnector.
Figure 3:
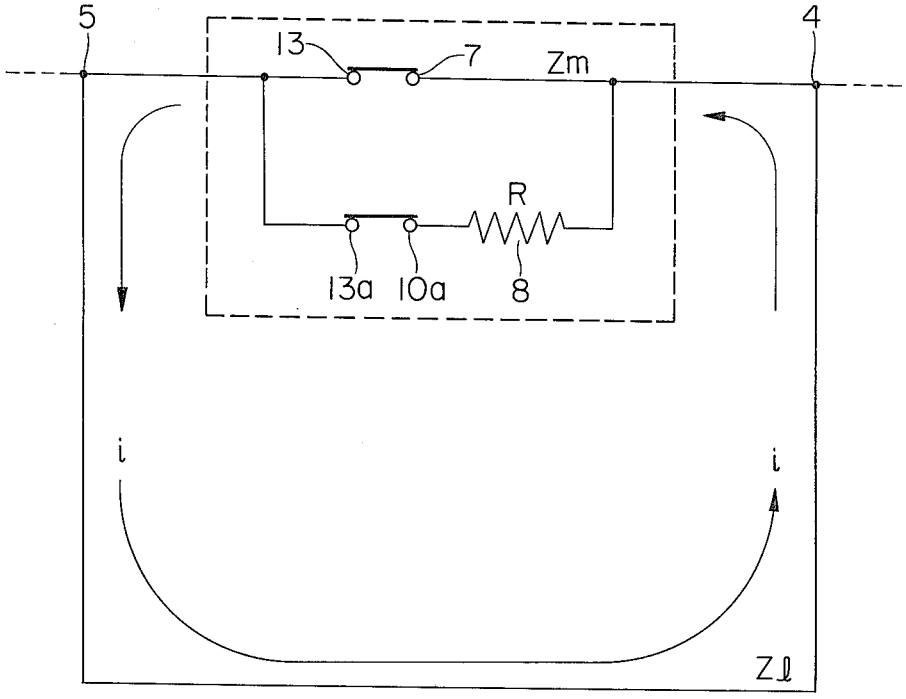
FIG. 3 is an equivalent circuit diagram showing the disconnector of FIG. 2 used for interrupting a loop current.
Figure 4:
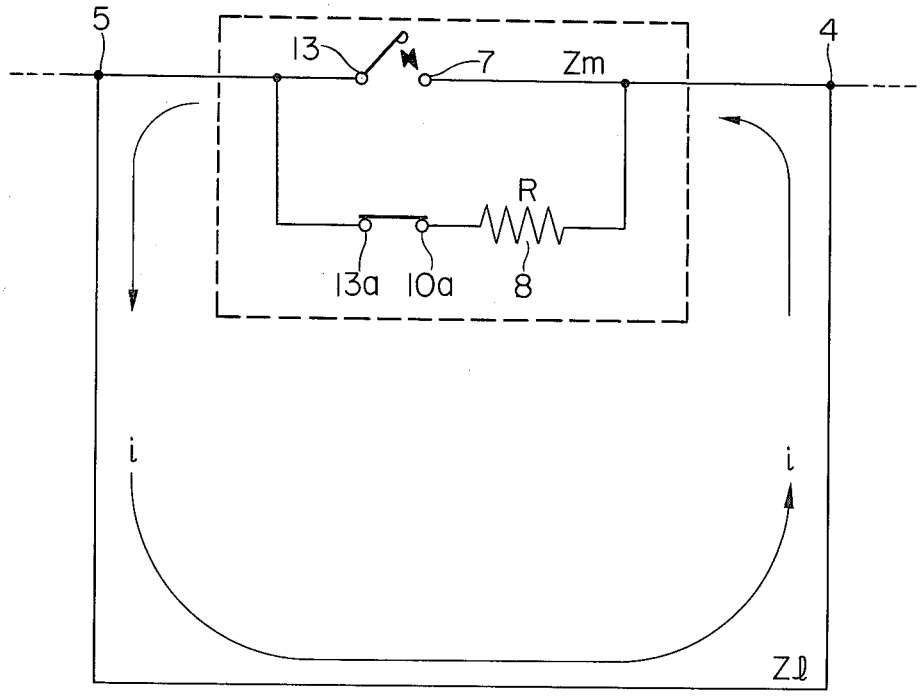
FIG. 4 is an equivalent circuit diagram showing the disconnector of FIG. 2 with main contacts broken apart.
Figure 5:
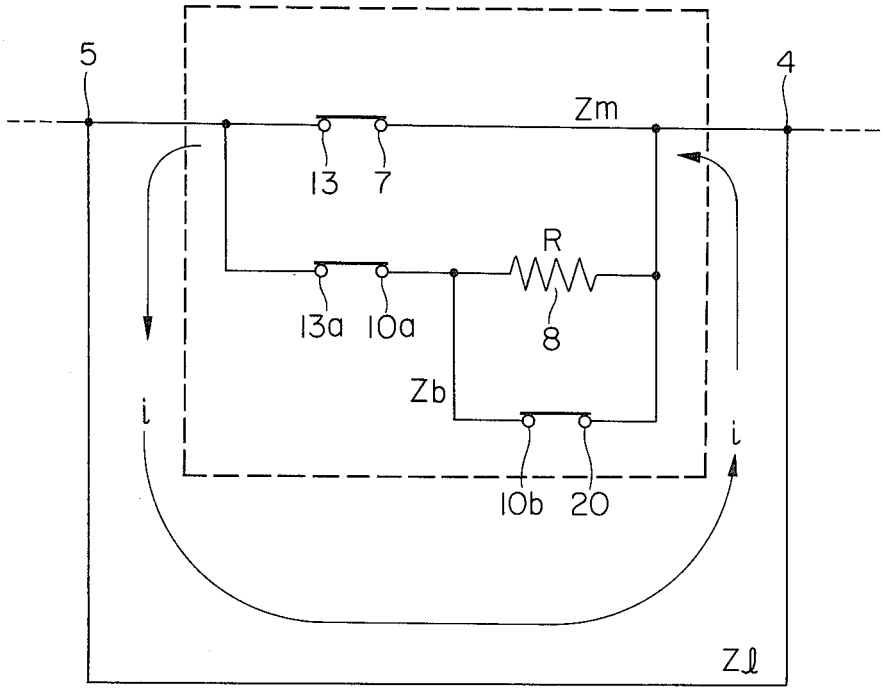
FIG. 5 is an equivalent circuit diagram showing an embodiment of the disconnector according to the invention.
Figure 6:
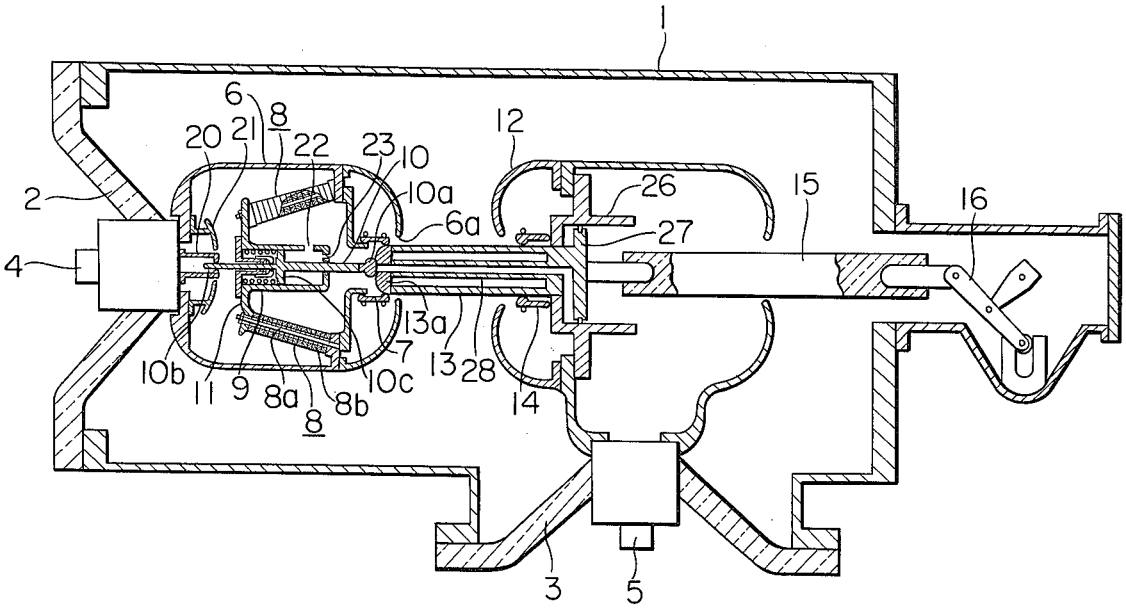
FIG. 6 is a longitudinal sectional view showing the construction of the embodiment of the disconnector shown in FIG. 5.
Figure 7:
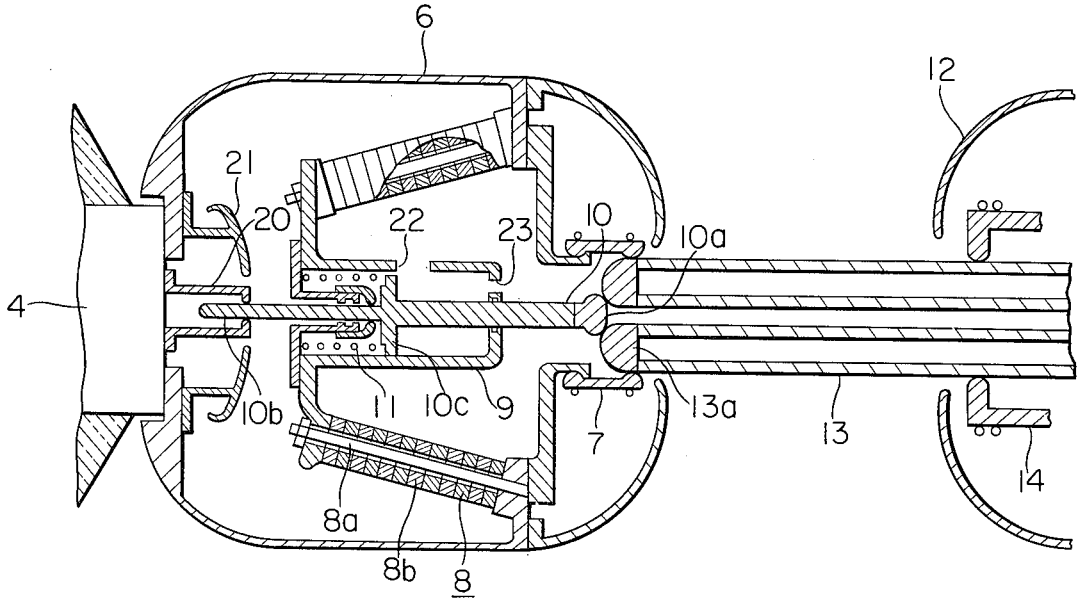
FIG. 7 is a fragmentary enlarged-scale longitudinal sectional view showing part of the embodiment of FIG. 6.
Figure 8:
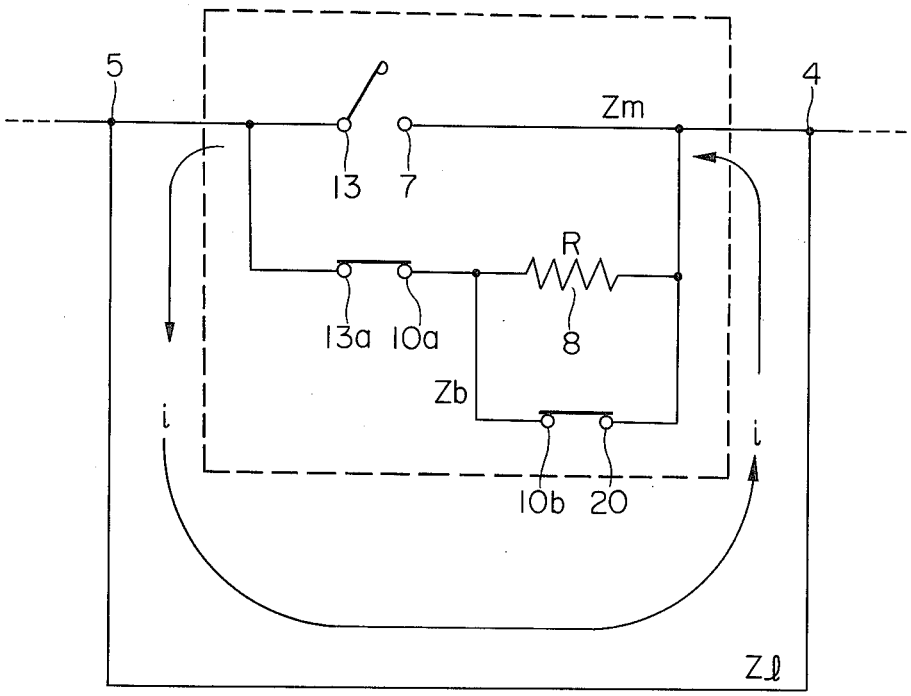
FIG. 8 is an equivalent circuit diagram showing the embodiment of FIG. 6 with main contacts broken apart.

FIG. 5 is an equivalent circuit diagram of the disconnector according to the invention, FIG. 6 is a longitudinal sectional view showing the construction of the disconnector of FIG. 5, and FIG. 7 is a fragmentary enlarged-scale sectional view showing part of the construction of FIG. 7. Referring to thse Figures, a pair of bypass contacts 10*b* and 20 are provided in series with the resistor 8. The bypass contact 20 is a fixed bypass contact. The bypass contact 10*b* is a movable bypass contact 10*b* which can be brought into contact with and broken apart from the fixed bypass contact 13. The movable bypass contact 10*b* is integral with the arcing contact 10*a* via the support rod 10. The bypass contacts 10*b* and 20 are adapted to be broken apart *after* the arcing contacts 10*a* and 13*a* have been broken apart and be brought into contact again with each other *after* the arcing contacts 10*a* and 13*a* have been brought into contact. Designated at 22 and 23 are nozzles for controlling the operating speed of the arcing contact 10*a*. As a piston 10*c* which is moved by a biasing force of the spring 11 compresses gas in the spring case 9, the gas is discharged through the nozzles 22 and 23, thereby changing the speed of the arcing contact 10*a*. In FIG. 5, Zm is the impedance of the main current path of the disconnector, Zb is the impedance of the circuit including the arcing contact 10*a*, support rod 10 and bypass contact 10*b*, Zl is the impedance of the loop established at the time of the switching of the system, and indicated at R is the resistance of the resistor 8.

Generally, Zm, Zb, Z and R are related as $$Zb \simeq Zm << Zl << R \qquad (2)$$

The function and operation of the disconnector according to the invention will now be described.

FIGS. 8 to 11 show the state of the disconnector immediately after the start of the isolating operation when interrupting the loop current. As the main contact 13 is moved, the main contacts 7 and 13 are broken apart. At this time, the arcing contacts 10*a* and 13*a* and bypass contacts 10*b* and 20 are in their closed state so that the resistor 8 is shunted by the bypass contacts 10*b* and 20.

In this stage, Zm and Zb are related as $Zb \simeq Zm$ from the inequality 2. Thus, when the main contacts 7 and 13 are broken apart, the loop current i turns to flow entirely through the path including the bypass contacts 10*b* and 20 and arcing contacts 10*a* and 13*a*. For this reason, no substantial damage is caused to the main contacts 7 and 13 due to the arcing.

Figure 9:
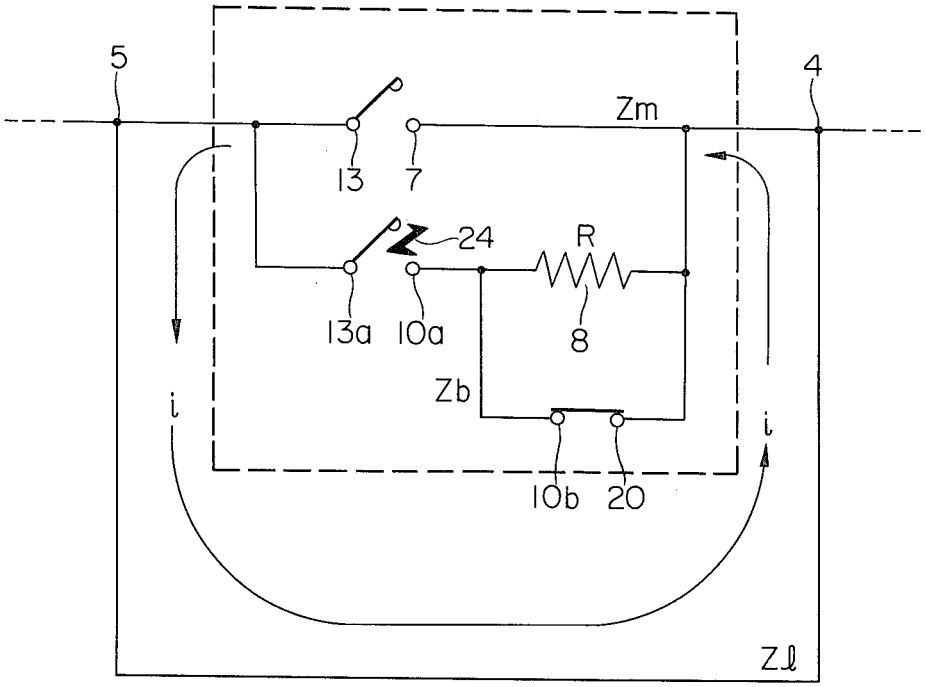
FIG. 9 is an equivalent circuit diagram showing the embodiment of FIG. 6 with arcing contacts broken apart after the state of FIG. 8.
Figure 12:
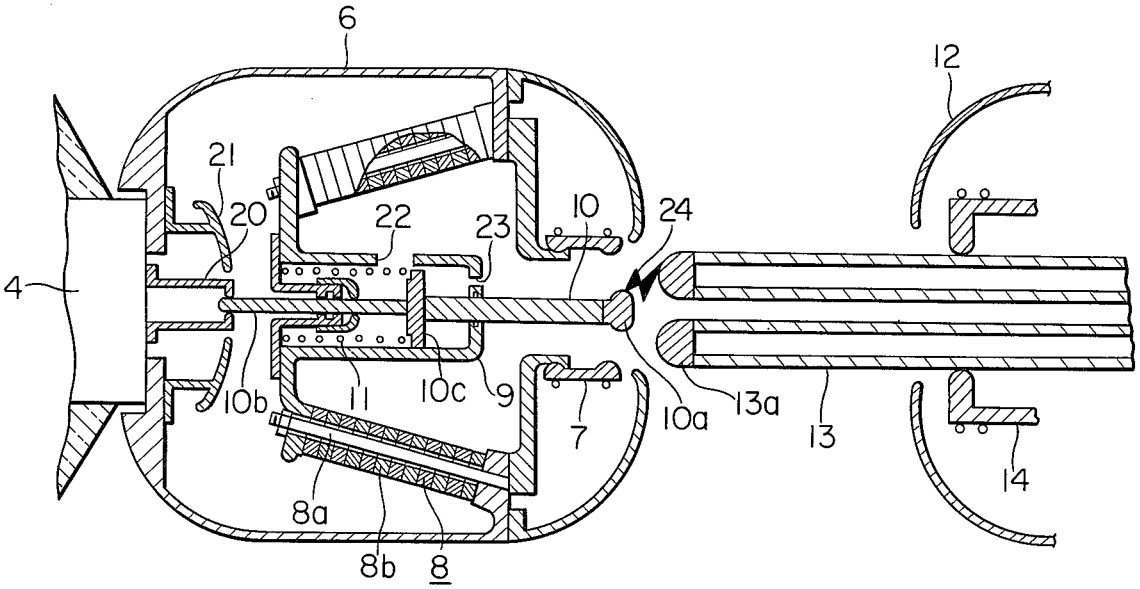
FIG. 12 is a view similar to FIG. 7 but with arcing contacts broken apart after the state of FIG. 11.

With further movement of the main contact 13, a state as shown in FIGS. 9 and 12 results. In this state, the piston 10*c* which is integral with the arcing contact 10*a* has cleared the nozzle 22 formed in the spring case 9. Thus, as soon as this state is reached, the speed of the arcing contact 10*a* is suddenly reduced. In consequence, the arcing contact 10*a* commences to be broken apart from the movable arcing contact 13*a*, producing an arc 24 between both the arcing contacts 10*a* and 13*a*.

The arc produced when interrupting the loop current as mentioned may be extinguished by making use of a flow of gas produced in a flow guide 28 by a puffer cylinder 28 and a piston 27 as shown in FIG. 6.

Figure 10:
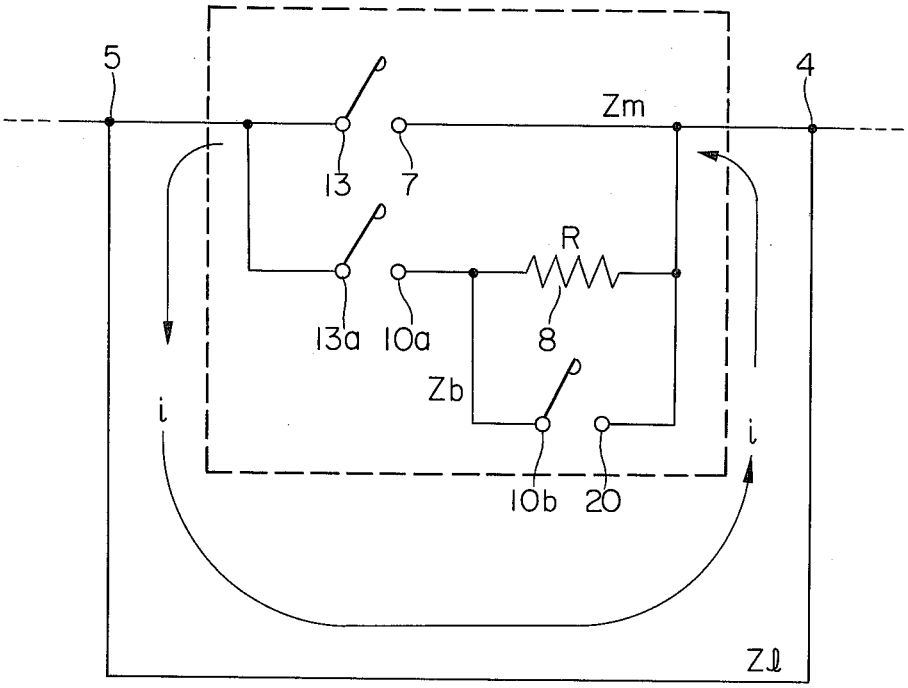
FIG. 10 is an equivalent circuit diagram showing the embodiment of FIG. 6 with bypass contacts broken apart after the state of FIG. 9.
Figure 13:
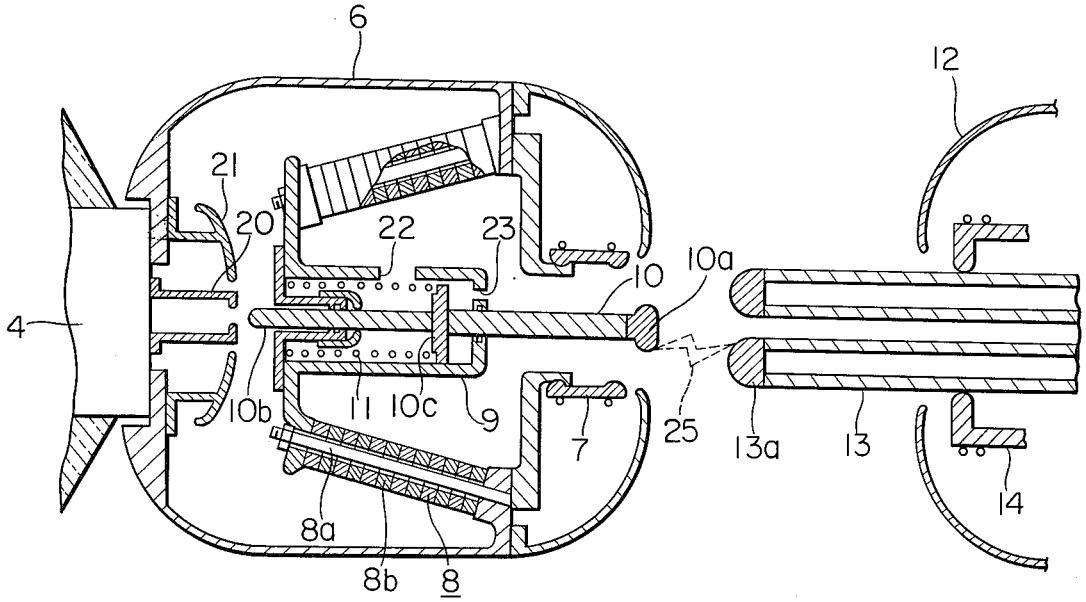
FIG. 13 is a view similar to FIG. 7 but with bypass contacts broken apart after the state of FIG. 12.

With further movement of the main contact 13, a state as shown in FIGS. 10 and 13 results. More particularly, after the arc produced between the arcing contacts 10*a* and 13*a* when interrupting the loop current has been extinguished, the movable bypass contact 10*b* integral with the arcing contact 10*a* commences to be broken apart from the fixed bypass contact 20. At this time, the main contacts 7 and 13 and arcing contacts 10*a* and 13*a* have already been broken apart, that is, it is not that a circuit carrying current is broken when the bypass contacts 10*a* and 20 are broken apart.

Figure 11:
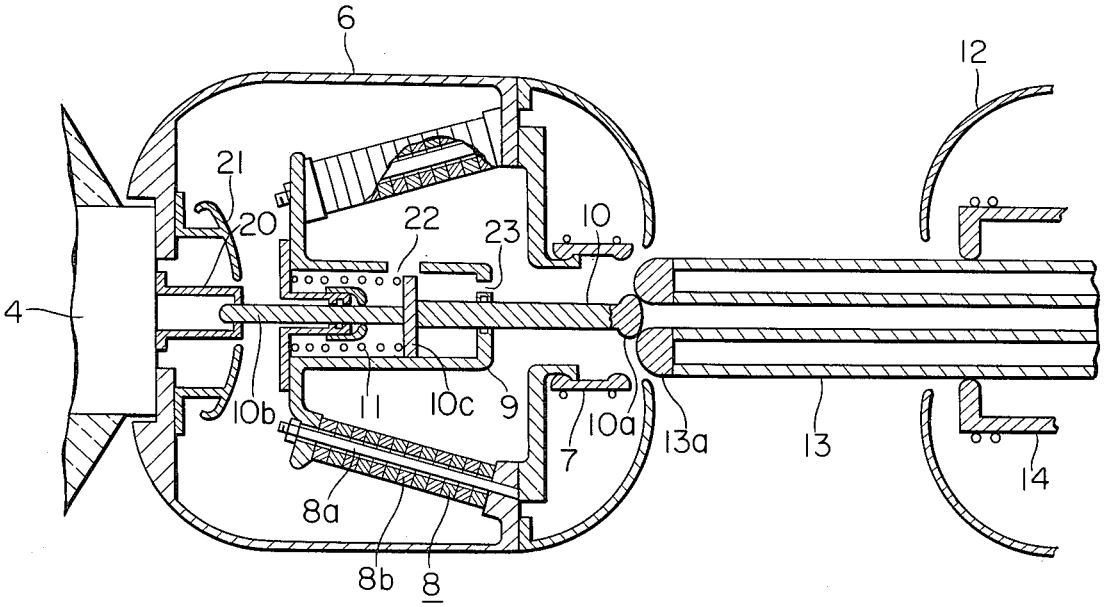
FIG. 11 is a view similar to FIG. 7 but with main contacts broken apart.

When isolating a non-load bus bar, it is necessary to suppress the switching surge by inserting a resistor in series with the circuit including the disconnector as noted before. The switching surge is generally proportional to the potential difference between two contacts of the disconnector at the time of the re-arcing. The intercontact potential difference is proportional to the intercontact distance at the time of the discharge. Therefore, the high surge which is so high that it must be suppressed by inserting a resistor, occurs in case when an arc is produced with the main contact 13 at a certain distance from the arcing contact 10 (the distance being specifically $\frac{1}{4}$ of $\frac{1}{3}$ of the full inter-contact distance although it depends on the apparatus). When the main contact 13 is in a state in the initial stage of operation as shown in FIGS. 11 and 12, the bypass contacts 10*b* and 20 are not broken apart yet, so that the surge suppression resistor 8 is in the shunted state.

FIG. 13 shows the state in which the main contact 13 is broken apart from the arcing contact 10*a*. In this state, the resistor 8 is connected in series with the arcing contacts 10*a* and 13*a* since the bypass contacts 10*b* and 20 are broken apart. If re-arcing 25 is produced between the contacts at this time, the resultant switching surge can be effectively disposed with by the resistor 8.

Figure 14:
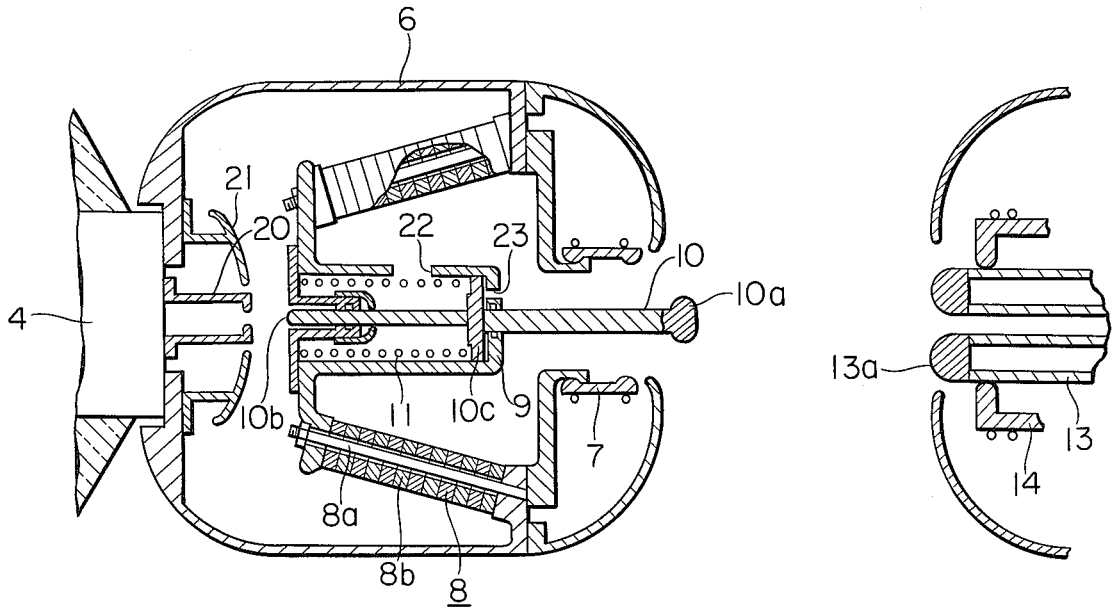
FIG. 14 is a view similar to FIG. 7 but showing a state of the disconnector when the isolating operation is completed.

FIG. 14 shows the disconnector when the isolating operation is completed. When the re-closure of the no-load bus bar by the disconnector is started from the state of FIG. 14, re-arcing is produced before the arcing contact 13*a* is brought into contact with the fixed arcing contact 10*a*. At this time, the surge suppression resistor provides effective action for all re-arcing.

As has been described in the foregoing, the disconnector having bypass contacts according to the invention can interrupt a loop current in one case and suppress the switching surge generated at the time of the switching of the no-load bus bar with the resistor in the other case.

The bypass contacts serve to insert the surge suppression resistor in the circuit of the arcing contacts or shunt the resistor. This means that with a disconnector which has the purpose of interrupting loop current and is not provided with any resistor, the bypass contacts may be used as the arcing contacts. That is, by providing two pairs of arcing contacts and causing these two pairs of contacts to be broken apart substantially simultaneously, it is possible to ensure reliable interruption of the loop current and prevent wear of the main contacts.

What is claimed is:

1. A gas insulated disconnector comprising:

a pair of arcing contacts;

a surge suppression resistor connected in series with said arcing contacts;

a pair of main contacts connected in parallel with the series circuit consisting of said arcing contacts and resistor;

a pair of bypass contacts connected in parallel with said resistor and in series with said pair of arcing contacts; and means for breaking said bypass contacts apart after said arcing contacts have been broken apart during a disconnector opening operation and for bringing said bypass contacts into contact with each other after said arcing contacts are brought into contact during a disconnector closing operation.

2. A gas insulated disconnector according to claim 1, wherein one of said pair arcing contacts is coupled to the fixed one of said main contacts while the other arcing contact is made integral with one of said pair bypass contacts and urged by a spring toward the movable one of said main contacts.

3. A gas insulated disconnector according to claim 2, which further comprises a support rod provided at one end with the other one of said pair arcing contacts and at the other end with one of said bypassing contacts, and a spring case for adjusting the speed of movement of said supporting rod, said spring case accommodating said spring, said support rod being slidably extending through said spring case.

4. A gas insulated disconnector comprising:

two pairs of arcing contacts connected in series with one another and adapted to be broken apart substantially simultaneously; and a pair of main contacts connected in parallel with said series circuit of said pairs of arcing contacts and adapted to be broken apart prior to said arcing contacts.

* * * * *